United States Patent [19]

Hyytinen

[11] Patent Number: 4,620,384

[45] Date of Patent: Nov. 4, 1986

[54] HAMMER LOCK FOR BREECH LOADING FIREARMS

[75] Inventor: Timo Hyytinen, Jyväskylä, Finland

[73] Assignee: Valmet Oy, Helsinki, Finland

[21] Appl. No.: 616,083

[22] Filed: Jun. 1, 1984

[51] Int. Cl.[4] ..... F41C 7/00; F41C 19/18

[52] U.S. Cl. ..... 42/41; 42/69.01

[58] Field of Search ..... 42/41, 42 R, 42 A, 42 B, 42/44, 69 R

[56] References Cited

U.S. PATENT DOCUMENTS 1,834,544 12/1931 Klebe ..... 42/69 R 2,945,316 7/1960 Mulno ..... 42/41

*Primary Examiner*—Deborah L. Kyle

*Assistant Examiner*—Michael Carone

*Attorney, Agent, or Firm*—Cushman, Darby & Cushman

[57] ABSTRACT

Lock construction for the hammer of bulletbore firearms of foldable construction. The invention prevents the rearward movement, of the striker by the effect of the pressures of the gases from the gunpowder on firing of the arm, and also the ending up of the detonator material into the striker hole. The lock construction comprises a support fork, fitted in connection with a spindle of a folding lock of the arm, the said support fork being, in connection with the firing of the arm, shifted by the force of a spring to a hammer locking position. In this locking position the support fork rests against the hammer and, locks it in its forward position and thereby prevents the striker pin from being shifted rearwards by the force of the gunpowder gases. When the arm is being folded, owing to a camming arrangement between the spindle and the support fork, the support fork pivots to a hammer unlocking position so that the hammer can be cocked.

5 Claims, 6 Drawing Figures

HAMMER LOCK FOR BREECH LOADING FIREARMS

The present invention is concerned with a lock construction for the hammer of bullet-bore firearms of foldable construction. The invention prevents rearward movement of the striker effected by the pressures of the gases from the gunpowder on firing of the arm, and also the ending up of the detonator material into the striker hole when the striker moves rearward.

In the bullet-bore firearms of foldable construction, the strikers of the arms yield to some extent. Under these circumstances, the strikers do not support the detonator sufficiently at the stage of ignition of the cartridge. Thereat, the pressure of the gundpowder gases presses detonator material into the striker hole. Since the base of the cartridge shell must glide along the breech bottom of the arm at the initial stage of the folding, the detonator material pressed into the striker bores often causes quite a considerable force opposed to the starting of the folding of the arm, which has been experienced as a significant inconvenience. In prior art, attempts have been made to reduce this problem by reducing the diameter of the striker, but that results in a deterioration of the durability of the striker. The present invention suggests a simple and reliable solution for the problems discussed above.

In view of achieving this objective and those that come out later, the invention is mainly characterized in that the said lock construction comprises a support fork or a corresponding support member fitted in connection with the spindle of the locking member of the arm, the said support fork being fitted so that it is, in connection with the firing of the arm, shifted by the force of a spring to a locking position, in which position the support part of the said support fork, when resting against the striker, locks the striker in the forward position and thereby prevents the striker pin from being shifted rearwards by the force of the gunpowder gases, and that the said support fork is fitted in such a way that, when the arm is being folded, owing to the fitting between the spindle of the locking member and the support fork, the support fork pivots to an upper position so that the hammer or hammers of the striker can be cocked without obstacle.

In the following, the invention will be described in detail with reference to one embodiment of the invention, illustrated in the figures of the attached drawing, the invention being not confined to the details of the said embodiment.

FIG. 3A is a sectional view at III—III in FIG. 1.

In the following, as a background for the present invention, the mechanism of a bullet-bore firearm will be described only in the respects as is necessary in view of the understanding of the present invention. In the other respects, reference is made to the mechanisms of firearms of foldable construction which are in themselves known in prior art.

Figure 1:
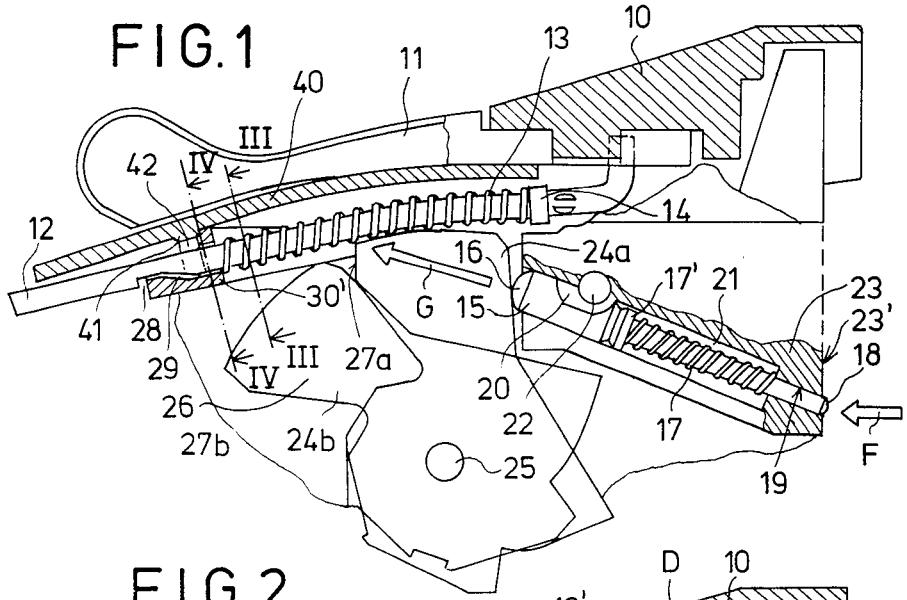
FIG. 1 shows a longitudinal vertical section of a firearm of foldable construction at the portion of the firing mechanism at the stage of the operation at which the firing has been performed.
Figure 2:
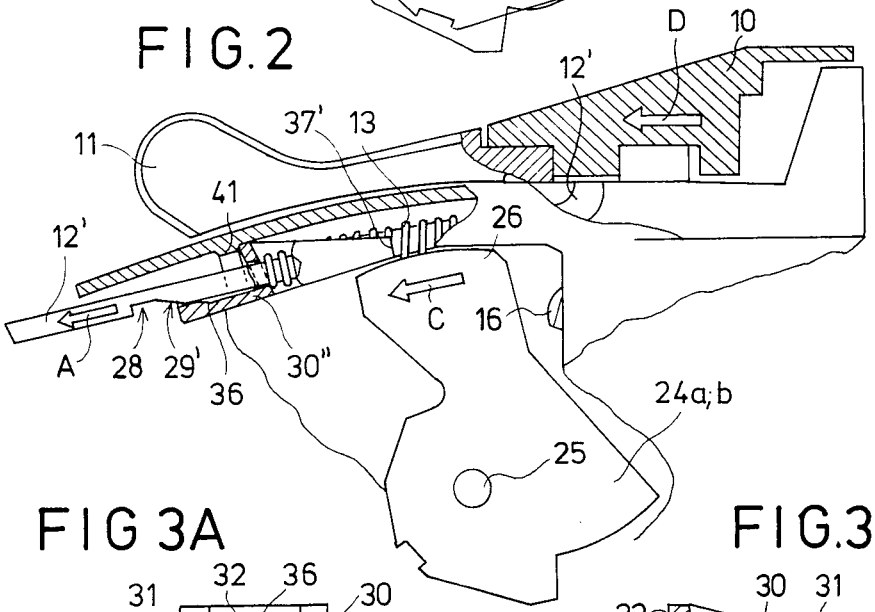
FIG. 2 shows the firing mechanism of the arm in a way corresponding to FIG. 1, at the stage at which the arm starts being folded.

In accordance with FIGS. 1 and 2, the arm includes a locking member 10, during whose operation the spindle 12 of the locking member is shifted in its longitudinal direction (arrow A in FIG. 2). In FIG. 1, the locking member 10,12 is in the locking position. The locking member 10 can be opened by pivoting the lever 11 placed above the locking mechanism. When the lever 11 is pivoted towards the side, the spindle 12 moves in the direction of the arrow A to position 12' (FIG. 2), whereupon the arm can be opened around the articulation shaft (not shown in the figures) of the stock.

Figure 3A:
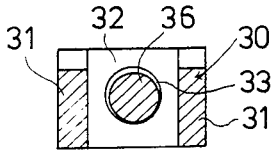
FIG. 3A shows the support fork of the construction in accordance with the invention. At the same time.
Figure 3B:
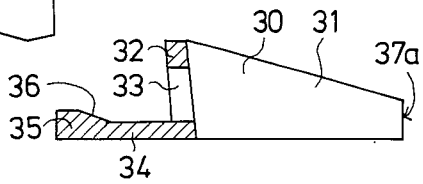
FIG. 3B shows the support fork in accordance with FIG. 3A as a central longitudinal vertical section.
Figure 4:
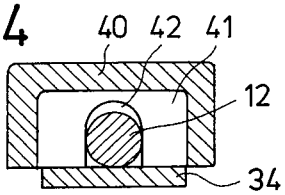
FIG. 4 shows a section IV—IV in FIG. 1.
Figure 3C:
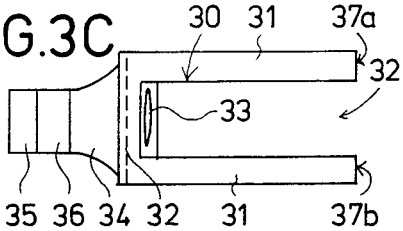
FIG. 3C shows the support fork in accordance with FIGS. 3A and 3B as viewed from above.

According to FIGS. 1 and 2, the firing mechanism of the arm comprises two percussion hammers 24*a* and 24*b*, placed side by side, both of which are fitted as pivoting on the same shaft 25. In the bore 21 placed in the breech bottom 23 of the arm, there is a striker 15 facing both of the hammers 24*a* and 24*b*, and a return spring 17 acts between the shoulder 17' of the striker 15 and the opposite end of the bore 21. In the breech bottom 23 there is a bore 19 which opens itself in the end 23' of the breech bottom 23, against which the base of the cartridge rests. At the end of the striker 15, there is a detonator pin 18, which strikes against the detonator (not shown). The gunpowder gases cause a force in the direction of the arrow F, which force attempts the press the detonator pin 18 back into the bore 19, which results in the drawback, in the prior-art firing mechanisms, that detonator material is extruded into the bore in front of the pin because the striker pin yields rearwards. As was stated above, this causes a detrimental counter-force apparent at the initial stage of the folding of the arm. In accordance with the invention, this problem has been solved by means of a particular support fork 30, whose location and operation come out from FIGS. 1 and 2, and the more detailed construction from FIGS. 3A, 3B, and 3C. In accordance with FIGS. 1 and 2, the support fork 30 rests with the upper edge of its vertical flange 32 against the shoulder 41 of the guide 40 of the spring of the locking member. This shoulder 41 is provided with a groove 42, through which the spindle 12 passes. The spindle 12 is provided with a notch 28 with a slanting face 29. The support fork 30 is provided with two lateral parts 31, and the spindle 12 is fitted as passing through the space 32' (FIG. 3C) between the said lateral parts 31 and through a hole 33 in the vertical flange 32. The fork 30 is provided with a projection part 34 and with an elevation 35 at its outer end. One support end 37*a* of the lateral parts 31 is provided for one hammer 24*a* and the other support end 37*b* for the other hammer 24*b*.

It is one favourable feature of the embodiment of the invention described above that the force required in the operation of the support fork 30 and pivoting the support fork 30 (FIG. 1) to its locked position 30' is produced by means of the same spring 13 as the closing force and the counter-force of the locking member. This force is produced thereby that the support fork 30 is fitted in connection with the spindle 12 by means of its hole 33 so that the force of the spring 13 is transmitted by the intermediate of the flange 32 of the support fork 30 so that, in relation to the support line of the support fork, which line is formed by the upper edge of the flange 32 and by the shoulder 41, the force of the spring 13 has a certain torque arm pivoting the support fork into the locked position 30'.

The lock construction for the hammer described above operates as follows for solving the problems discussed above. In accordance with FIG. 1, upon firing of the arm, a force acts upon the striker 15 which presses the outer end 16 of its corresponding hammer 15 against the striker 24, which causes a counter-force in the direction of the arrow G. In prior art, the striker yielded, because the counter-force consisted of the spring force of the striker alone. In accordance with FIG. 1, in the present invention, the rear face 27*a* of the hammer 24*a* rests against the support end 37*a* of the support fork 30', and the striker pin 18 cannot yield rearwards and, consequently, detonator material cannot penetrate into the bore 19 of the striker pin 18 at B, whereby the drawbacks described above can be avoided. The counter-force in the direction of the arrow G, resulting from the pressure of the gunpowder gases and transmitted by the striker 15, is received by the shoulder 41 of the stationary part 40 by the intermediate of the support fork 30.

After firing, when the arm starts being folded in view of removing the shell and cocking the percussion hammers 24*a*,24*b*, the spindle 12 of the locking member moves backwards in the direction of the arrow A to the position 12' (FIG. 2). Thereat the slanting face 29' at the notch 28 of the spindle 12' turns the support fork 30 to the position 30" by means of the force transmitted by its slanting face 36. This pivoting takes place around the upper edge of the vertical flange 32 of the support fork 30, which upper edge rests against the shoulder 41. Thereat, the support ends 37*a* and 37*b* of the support fork are also pivoted to the upper position shown in FIG. 2, whereat the percussion hammers 24 can pivot in the direction of the arrow C around their pivot pin 25 unhindered, i.e. unhindered by the support fork 30. When the arm is hereinafter folded back and closed, the locking member 10 is locked and the spindle 12 returns to the position shown in FIG. 1.

Hereinafter, when the arm is fired, either one of the hammers 24*a*,24*b* strikes forwards. This impact movement is not prevented by the support fork 30, because the curved upper faces 26 of the hammers 24 rest against the bottom face of the fork parts 31 so that the fork 30 can be pivoted upwards against the counter-force produced by the spring 13 and, at the stage when the front side of the hammers 24*a*,24*b* strikes against the end 16 of the striker 15, the support fork 30 snaps by the effect of the spring 13 into the locked position 30' shown in FIG. 1, whereby the drawbacks discussed above are avoided.

In the following, the patent claims will be given, whereat the various embodiments of the invention may show variation and differ from the example described above within the scope of the inventive idea defined in the said claims.

What is claimed is:

1. In a bullet-bore firearm of foldable construction having a hammer for a striker in the breech, means for locking the firearm against folding including a movable locking member and a spindle engaged therewith, said spindle and urged in one direction by a spring engaged with the spindle and a fixed shoulder in the firearm to move the locking member into a locking position and moved in the opposite direction when the locking member is moved to an unlocking position, the combination comprising:

means for locking the hammer in engagement with the striker on firing of the firearm to prevent rearward movement of the striker by firing gas pressure resulting in accumulation of detonator material in front of the striker in the firing pin hole, including:

detent means engaged with the spring and the shoulder to automatically lock the hammer in engagement with the striker on firing of the firearm and engageable by the spindle to unlock the hammer for cocking on movement of the locking member to said unlocking position to permit folding of the firearm.

2. The structure defined in claim 1 wherein the spindle is provided with a recess facing a projecting part of the detent means, said recess and said part have complementary slanting faces which cam said detent means to unlocking position.

3. The striker defined in claim 1 wherein there are two hammers and the detent means comprises a support fork engaged with the shoulder and having two lateral parts connected by an intermediate flange provided with a hole through which the spindle passes, the ends of said parts being engageable with the rear sides of said hammers to lock the same in engagement with the striker.

4. The structure defined in claim 3 wherein the flange rests against the shoulder and the fork pivots between a locking position and an unlocking position around the upper edge of said flange.

5. The structure defined in claim 4 wherein the flange is interposed between the shoulder and the spring so that the latter produces a force pivoting the fork into the locking position.

* * * * *